US008151374B2

(12) United States Patent
Wilcox

(10) Patent No.: US 8,151,374 B2
(45) Date of Patent: Apr. 10, 2012

(54) SKI, OUTDOOR ACTIVITY OR TACTICAL GOGGLE PROTECTIVE COVERING

(75) Inventor: Kendra A. Wilcox, Mt. Village, CO (US)

(73) Assignee: Deep Tech Products, LLC, Telluride, CO (US)

( * ) Notice: Subject to any disclaimer, the term of this patent is extended or adjusted under 35 U.S.C. 154(b) by 657 days.

(21) Appl. No.: 11/853,639

(22) Filed: Sep. 11, 2007

(65) Prior Publication Data

US 2009/0026095 A1 Jan. 29, 2009

(51) Int. Cl.
*A61F 9/02* (2006.01)

(52) U.S. Cl. ..... 2/426; 206/5

(58) Field of Classification Search ..... 2/426, 452; 206/5, 5.1, 6; 224/255
See application file for complete search history.

(56) References Cited

U.S. PATENT DOCUMENTS

| | | | | |
|---|---|---|---|---|
| 4,606,453 | A | 8/1986 | Burns | |
| 4,823,943 | A * | 4/1989 | Chang | 206/5 |
| 4,863,013 | A | 9/1989 | Eastman | |
| 4,951,811 | A * | 8/1990 | Lines | 206/5 |
| 4,953,695 | A | 9/1990 | Tallman | |
| 4,966,322 | A | 10/1990 | Zagorski et al. | |
| 5,014,846 | A * | 5/1991 | Walker et al. | 206/5 |
| 5,032,019 | A * | 7/1991 | Burchett | 351/158 |
| 5,213,241 | A * | 5/1993 | Dewar et al. | 224/222 |
| 5,299,682 | A * | 4/1994 | Tatar | 206/5 |
| 5,344,002 | A | 9/1994 | Baczkowski | |
| 5,735,393 | A | 4/1998 | Shiue et al. | |
| 5,878,443 | A | 3/1999 | Seiler | |
| 6,038,706 | A * | 3/2000 | Seiler | 2/426 |
| 6,478,145 | B2 * | 11/2002 | Mitchell | 206/5 |
| 6,640,346 | B2 * | 11/2003 | Dufresne | 2/424 |
| 6,907,617 | B2 * | 6/2005 | Johnson | 2/13 |
| 7,131,533 | B2 | 11/2006 | Anderson et al. | |
| 7,770,721 | B2 * | 8/2010 | Orner | 206/5 |

* cited by examiner

*Primary Examiner* — Katherine Moran
(74) *Attorney, Agent, or Firm* — Sheridan Law, LLC

(57) ABSTRACT

There are disclosed a protective cover for a lens of a goggle and a method of protecting a lens. In an embodiment, the cover has a front panel shaped to substantially contour the goggle, a first portion extending from the panel, a second portion extending from the panel, a first connector mechanism and a second connector mechanism configured to secure the front panel onto the lens, and openings sized to allow a strap of the goggle to extend away from the panel. In one embodiment, the method includes positioning the panel over the lens, positioning the first portion toward an inside portion of the lens, positioning the second portion toward the inside portion of the lens, and attaching the first portion and the second portion to secure the panel onto the lens. Other embodiments are also disclosed.

26 Claims, 9 Drawing Sheets

SKI, OUTDOOR ACTIVITY OR TACTICAL GOGGLE PROTECTIVE COVERING

This application claims priority of International (PCT) Patent Application Serial No. PCT/US07/74631, filed Jul. 27, 2007, by David W. Lofland and Kendra A Wilcox, for A SKI, OUTDOOR ACTIVITY OR TACTICAL GOGGLE PROTECTIVE COVERING, which in turn claims priority of U.S. Provisional Patent Application Ser. No. 60/820,593, filed Jul. 27, 2006, by David W. Lofland and Kendra A. Wilcox, for A SKI GOGGLE PROTECTIVE COVER. This application is incorporated herein by reference.

BACKGROUND

Ski goggle and other types of goggle devices generally have a lens for eye protection. As typically designed, the goggle is worn about the head of a skier, snowboarder, snowmobile or motorcycle operator, or other outdoor participant.

The goggle may be stored when not in use. Some forms of storage subject the lens of the goggle to potential damage, including scratching. This is typically the case when the goggle is worn on a protective helmet. In between use, the helmet may be cast about such that the lens is subjected to damaging contact. For example, lenses may become scarred when goggles remain on a helmet between uses.

Other types of storage, such as an equipment bag, may also allow damage to the lens of the goggle.

Some types of prior art devices may be relatively bulky, and may not be conducive to carrying in a pocket for intermittent use. Other types of prior art devices may be configured for carrying the goggles, including the strap, within a pocket. This type of configuration requires removal from a helmet.

Accordingly, the prior art devices do not provide adequate protection for the lens of the goggle without significant drawbacks.

SUMMARY OF THE INVENTION

In an embodiment, there is provided a protective cover for a lens of a ski goggle, the protective cover comprising a front panel defining a top boundary and a bottom boundary in opposition to one another, the top boundary and the bottom boundary shaped to substantially contour to portions of the ski goggle, and the front panel forming a right lateral edge and a left lateral edge in opposition to one another, a first portion extending from the top boundary of the front panel to a first end, a first connector mechanism adjacent the first end, and the first portion forming a right lateral edge and a left lateral edge in opposition to one another, a second portion extending from the bottom boundary of the front panel to a second end, a second connector mechanism adjacent the second end, and the second portion forming a right lateral edge and a left lateral edge in opposition to one another, wherein the first connector mechanism and the second connector mechanism are configured to selectively attach the first portion and the second portion to one another so as to secure the front panel onto the lens of the ski goggle, wherein the right lateral edge of the front panel, the right lateral edge of the first portion, and the right lateral edge of the second portion provide an opening sized to allow a strap of the ski goggle to extend away from the right lateral edge of the front panel when the first connector mechanism and the second connector mechanism are attached together, and wherein the left lateral edge of the front panel, the left lateral edge of the first portion, and the left lateral edge of the second portion provide an opening sized to allow a strap to extend away from the left lateral edge of the front panel when the first connector mechanism and the second connector mechanism are attached together.

In another embodiment, there is provided a protective cover for a lens of a goggle, the protective cover comprising a front panel shaped to substantially contour to portions of the goggle, a first portion extending from the front panel to a first end, and a first connector mechanism adjacent the first end, and a second portion extending from the front panel to a second end, a second connector mechanism adjacent the second end, the first connector mechanism and the second connector mechanism selectively attaching to one another so as to secure the front panel onto the lens of the goggle, and the front panel, the first portion, and the second portion providing openings in opposition to one another when the first connector mechanism and the second connector mechanism are attached together, wherein each of the openings are sized to allow a strap of the goggle to extend away from the front panel.

In yet another embodiment, there is provided a method of protecting a lens of a ski goggle, the method comprising positioning a front panel of a protective cover over an outside portion of the lens of the ski goggle, positioning a first portion extending from the front panel over one portion of the ski goggle toward an inside portion of the lens, positioning a second portion extending from the front panel over another portion of the ski goggle toward the inside portion of the lens, and attaching the first portion and the second portion to one another so as to secure the front panel onto the lens of the ski goggle.

Other embodiments are also disclosed.

BRIEF DESCRIPTION OF THE DRAWINGS

Illustrative embodiments of the invention are illustrated in the drawings, in which.

DETAILED DESCRIPTION

Figure 1:
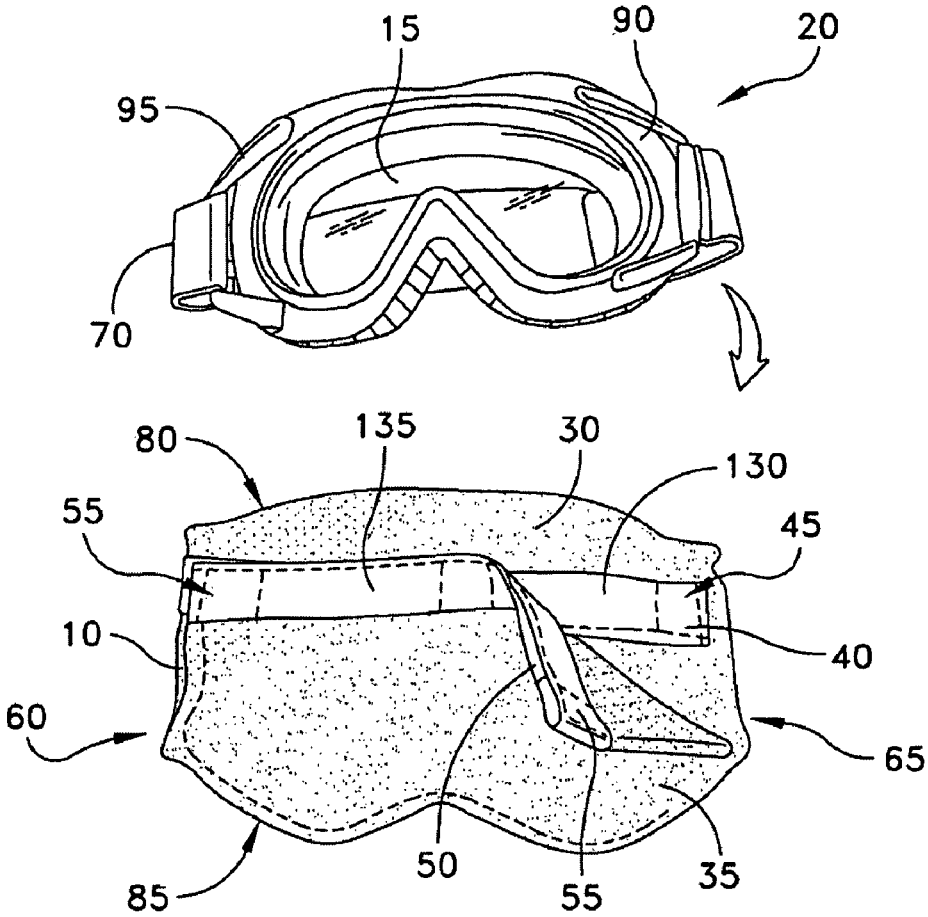
FIG. 1 illustrates a rear view of an exemplary embodiment of a ski goggle protective cover with a ski goggle.
Figure 2:
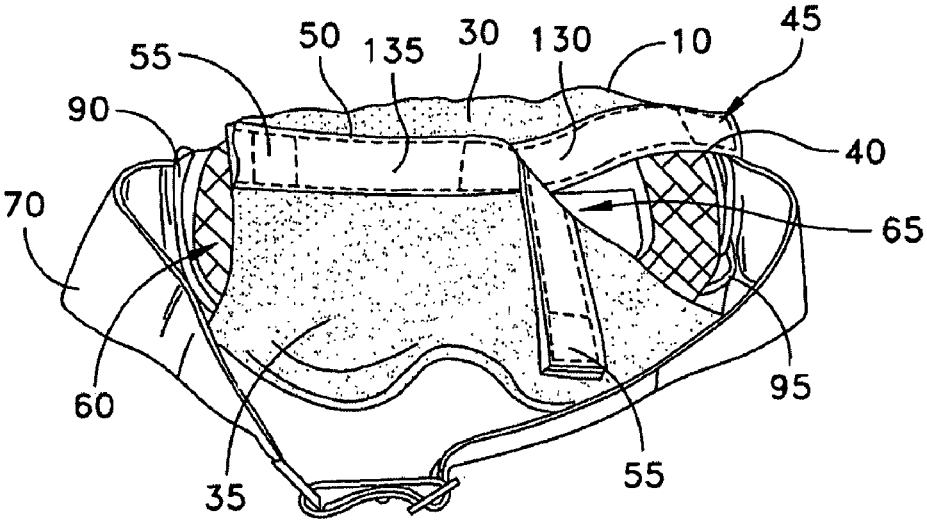
FIG. 2 illustrates a rear view of the ski goggle protective cover of FIG. 1 in a surrounding configuration about the ski goggle.
Figure 3:
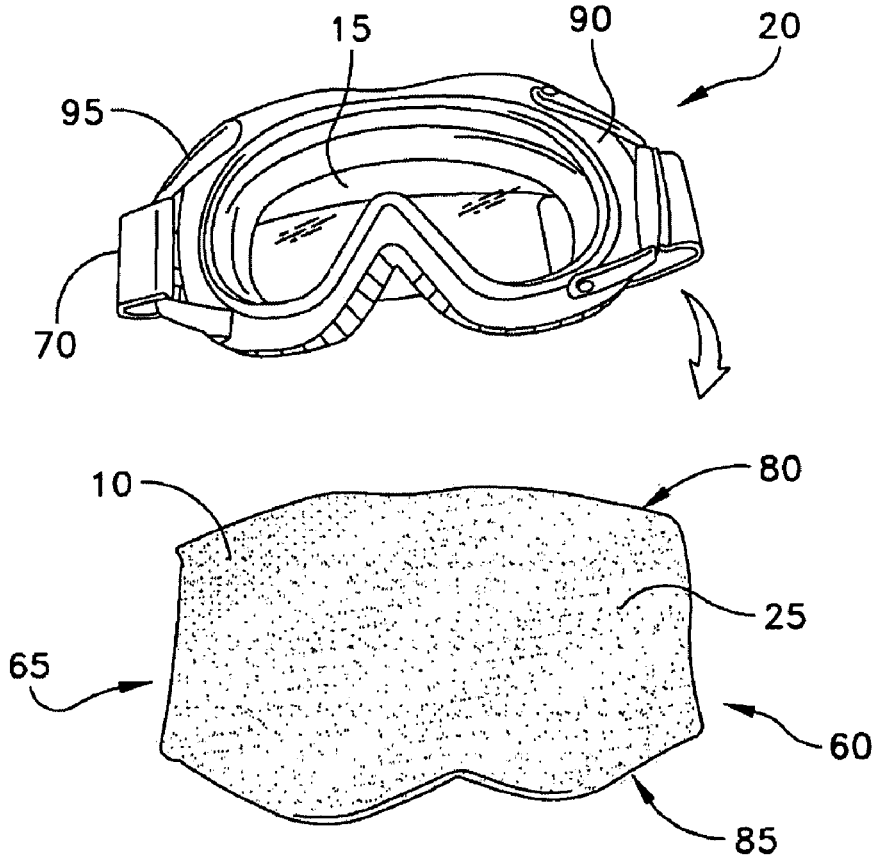
FIG. 3 illustrates a front view of the ski goggle protective cover of FIG. 1, and illustrate the ski goggle disposed outside of the protective cover.
Figure 4:
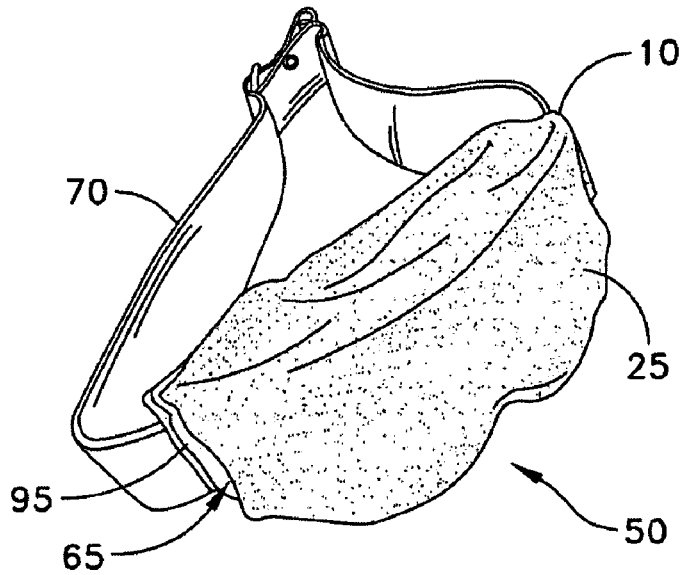
FIG. 4 illustrates a front view of the ski goggle protective cover of FIG. 2 in the surrounding configuration about the ski goggle.
Figure 5:
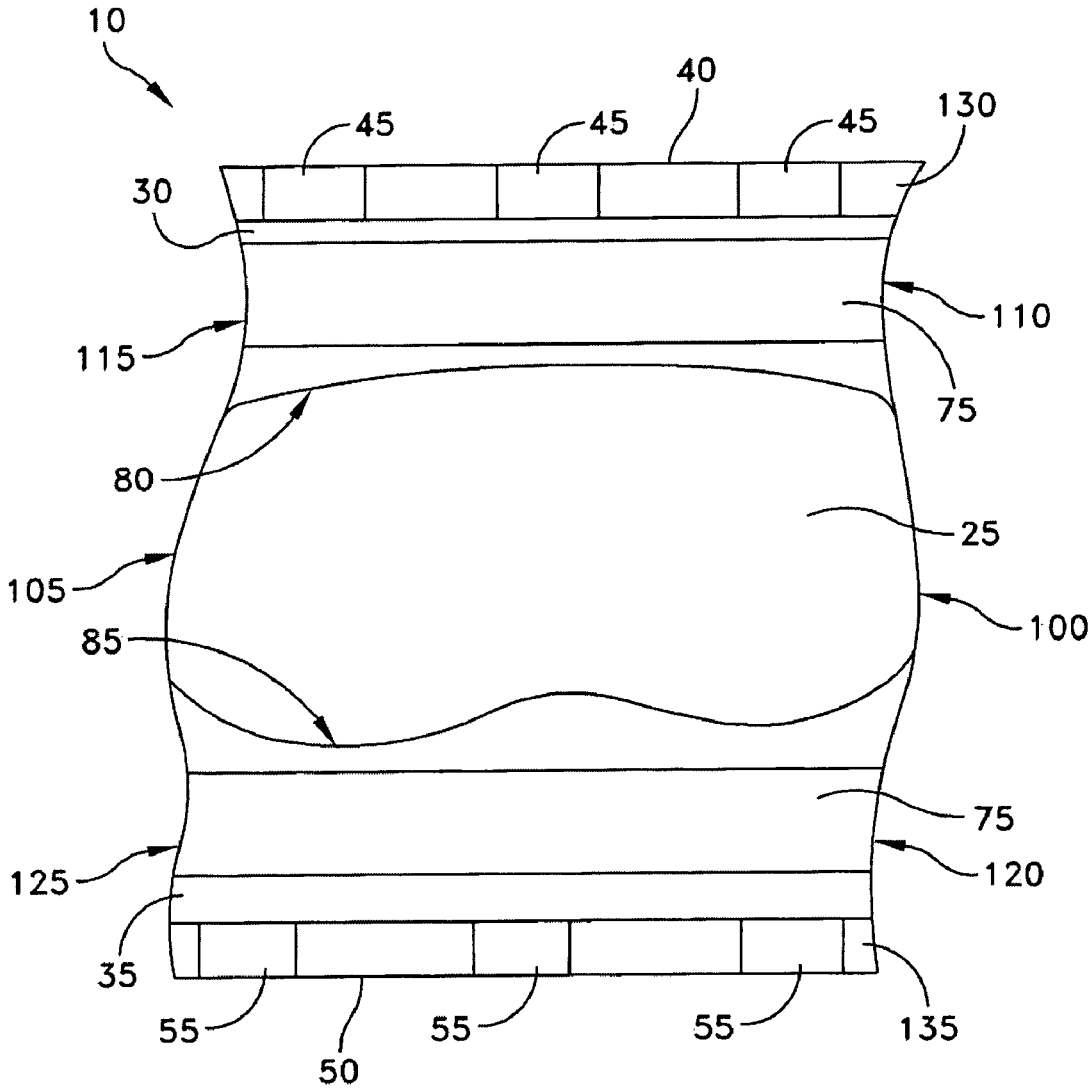
FIG. 5 illustrates a front view of the ski goggle protective cover of FIG. 1 in an opened configuration.
Figure 6:
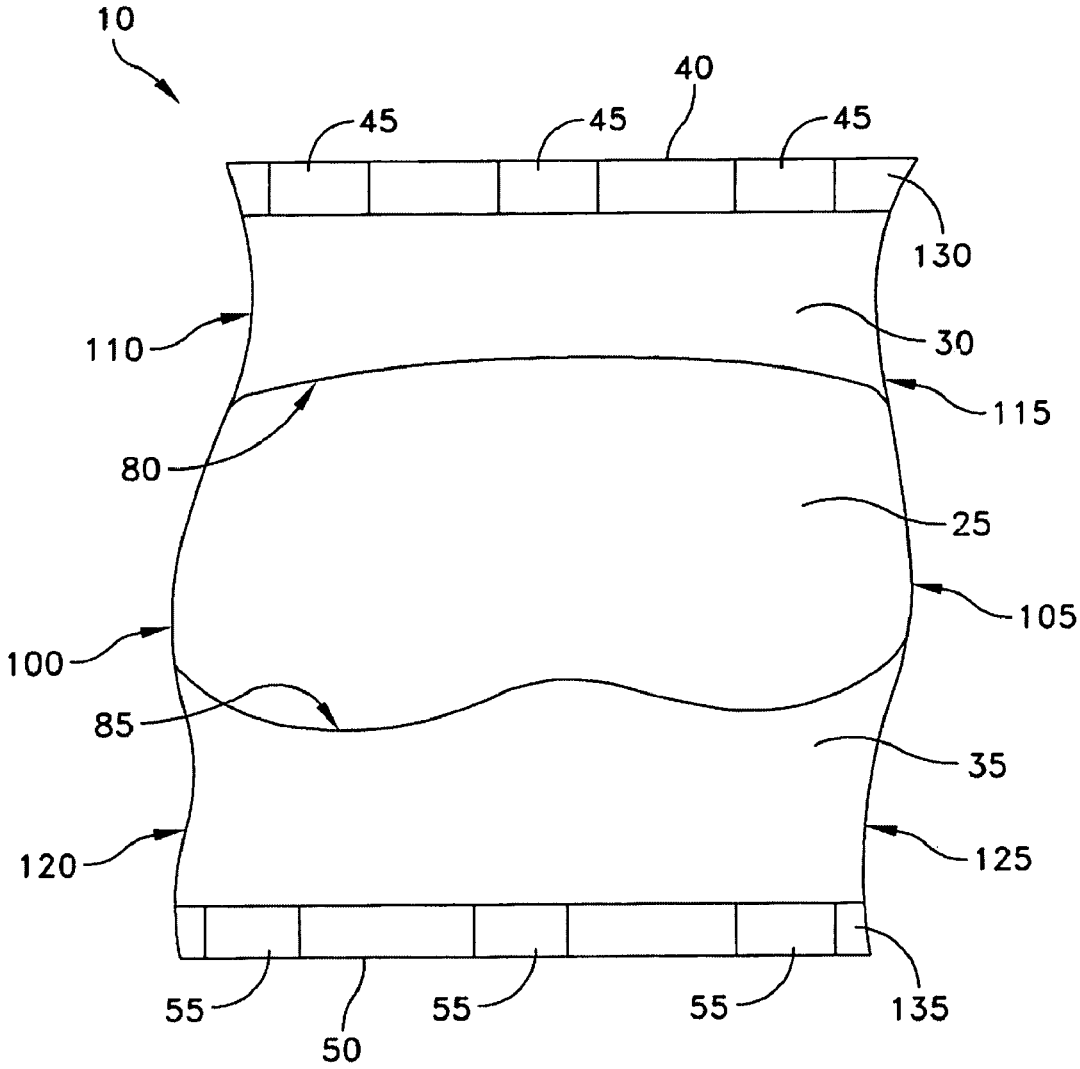
FIG. 6 illustrates a rear view of the ski goggle protective cover of FIG. 1 in an opened configuration.
Figure 7:
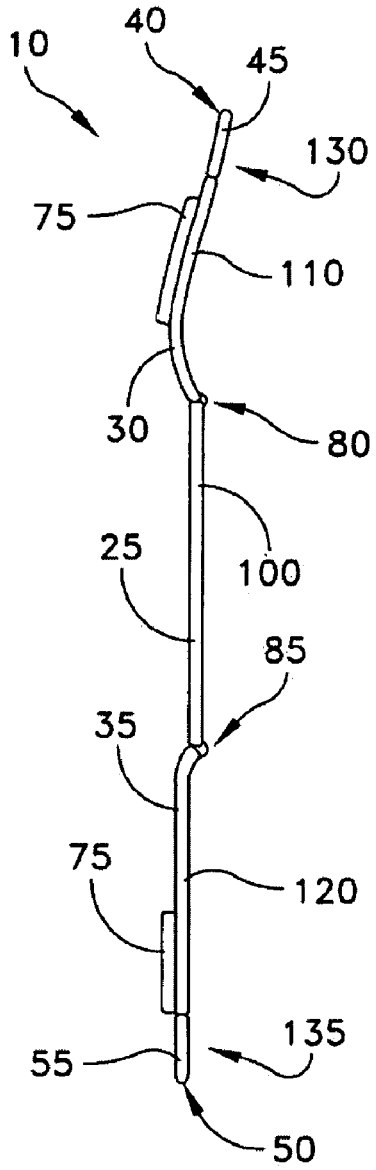
FIG. 7 illustrates aright side view of the ski goggle protective cover in an opened configuration.

FIGS. 1-10 illustrate an exemplary embodiment of a protective cover 10 for a lens 15 of a goggle 20 (FIGS. 1 and 3). As best illustrated in FIGS. 5 and 6, protective cover 10 may include a front panel 25, a first portion 30, and a second portion 35. Front panel 25 may be shaped to substantially contour to portions of goggle 20.

First portion 30 may extend from front panel 25 to a first end 40. A first connector mechanism 45 may be disposed adjacent to first end 40. Second portion 45 may extend from front panel 25 to a second end 50. A second connector mechanism 55 may be disposed adjacent second end 50. First connector mechanism 45 and second connector mechanism 55 may selectively attach to one another. This secures front panel 25 onto lens 15 of goggle 20. Front panel 25, first portion 30, and second portion 35 provide openings 60, 65 in opposition to one another when first connector mechanism 45 and second connector mechanism 55 are attached together. Each of openings 60, 65 may be sized to allow a strap 70 of goggle 20 to extend away from front panel 25.

Figure 8:
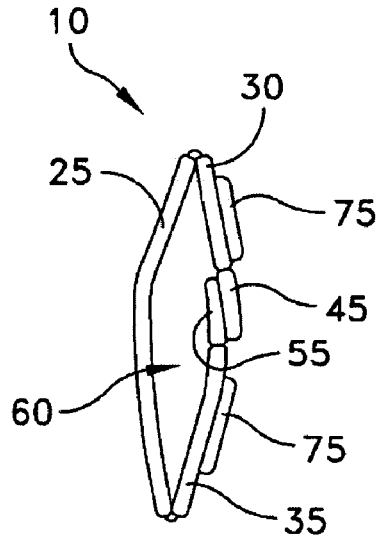
FIG. 8 illustrates a right side view of the ski goggle protective cover in a closed configuration.
Figure 9:
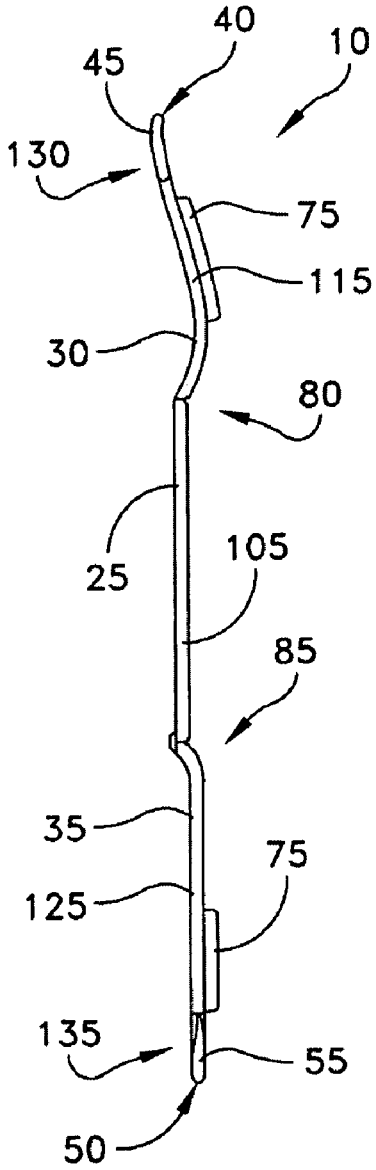
FIG. 9 illustrates a left side view of the ski goggle protective cover in an opened configuration.
Figure 10:
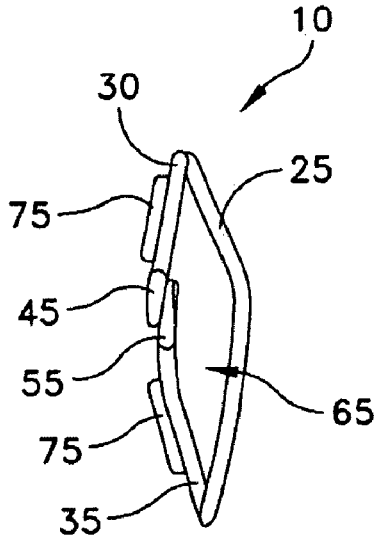
FIG. 10 illustrates a left side view of the ski goggle protective cover in a closed configuration.

Protective cover 10 may be used to cover various types of goggles. In one embodiment, front panel 25, first portion 30, and second portion 35 may be configured to cover a ski goggle. In other embodiments, cover 10 may be configured to cover snowmobile goggles, motorcycle goggles, tactical, or other types of goggles. Protective cover 10 may be used with goggle 20 attached to a helmet or separate from a helmet. As best illustrated in FIGS. 8 and 10, and in an embodiment, front panel 25, first portion 30, and second portion 35 may be configured to form a continuous sleeve when first end 40 and second end 50 are attached to one another.

As illustrated in FIGS. 5-10, a traction material 75 may be disposed on either, or both of, first portion 30 and second portion 35. Traction material 75 may be configured to prevent sliding of first portion 30 or second portion 35 with respect to helmet (not shown). Traction material 75 may include a strip of neoprene rubber. This eliminates the hassle of removing goggle 20 from the helmet and, when not in use, putting the goggle in a specific bag.

As illustrated in FIGS. 5 and 6, front panel 25 has a top boundary 80 and a bottom boundary 85. In one embodiment, top boundary 80 and bottom boundary 85 are asymmetrical to one another. This asymmetrical configuration allows protective cover 10 to substantially contour to portions of goggle 20.

As shown in FIGS. 2 and 4, openings 60, 65 may be sized to engage a first frame portion 90 and a second frame portion 95 of the goggles between lens 15 and strap 70, respectively.

Referring still to FIGS. 5 and 6, front panel 25 forms a right lateral edge 100 and a left lateral edge 105 in opposition to one another. First portion 30 may extend from top boundary 80, and may form a right lateral edge 110 and a left lateral edge 115 in opposition to one another. Second portion 35 may extend from bottom boundary 85, and may form a right lateral edge 120 and a left lateral edge 125 in opposition to one another. When attached together, opening 60 may be formed by right lateral edge 100 of front panel 25, right lateral edge 100 of first portion 30, and right lateral edge 120 of second portion 35. Generally, opening 60 is sized to allow strap 70 of ski goggle 20 to extend away from right lateral edge 100 of front panel 25 when first connector mechanism 45 and second connector mechanism 55 are attached together. Similar to the right side, and when attached together, opening 65 may be formed by left lateral edge 105 of front panel 25, left lateral edge 110 of first portion 30, and left lateral edge 115 of second portion 35. Generally, opening 65 is sized to allow strap 70 to extend away from left lateral edge 105 of front panel 25 when first connector mechanism 45 and second connector mechanism 50 are attached together.

In an embodiment, front panel 25, first portion 30, and second portion 35 may include individual fabric panels sewn together. For example, each of the fabric panels may include one or more sections of polyester fleece, polyester micro-fiber, polyester fleece with nylon shell material, polyester micro-fiber with nylon shell material, and tactical fabrics as specified by the FBI, military, SWAT teams, etc. Protective cover 10 may be made of one or more materials, such as polar fleece, with water-resistant and dirt-repelling properties.

As shown in FIGS. 5 and 6, right lateral edge 100 of front panel 25 and left lateral edge 105 of front panel 25 may be mirror images of one another. Right lateral edge 110 of first portion 30 and right lateral edge 110 of second portion 35 each extend continuously from right lateral edge 105 of front panel 25, respectively. Left lateral edge, 115 of first portion 30 and left lateral edge 125 of second portion 35 may each extend continuously from left lateral edge 105 of front panel 25, respectively.

In an embodiment, first connector mechanism 45 of first portion 30 may include a first set of magnets (referred to as magnets 45.) Second connector mechanism 55 of second portion 35 may include a second set of magnets (referred to as magnets 55.) First set of magnets 45 may be disposed in a horizontal margin 130 adjacent to first end 40. Second set of magnets 55 may be disposed in a horizontal margin 135 adjacent to second end 50. With magnets 45 and magnets 55, protective cover 10 may "snap" around a pair of goggles so as to protect lens 15 from scratching as well as prevent fogging.

In an embodiment, first connector mechanism 45 of first portion 30 may include hook-and-loop fasteners (which may include Velcro brand hook-and-loop fasteners, and are referred to as hook-and-loop fasteners 45.) Second connector mechanism 55 of second portion 35 may include hook-and-loop fasteners (which may include Velcro brand hook-and-loop fasteners, and are referred to as hook-and-loop fasteners 55.) Hook-and-loop fasteners 45 may be disposed in a horizontal margin 130 adjacent to first end 40. Hook-and-loop fasteners 55 may be disposed in a horizontal margin 135 adjacent to second end 50. With hook-and-loop fasteners 45 and hook-and-loop fasteners 55, protective cover 10 may protect lens 15 from scratching as well as prevent fogging.

The protective cover has many advantages. These advantages include, but are not limited to, protecting goggles from scratching and fogging. The protective cover works both on and off a helmet. In an embodiment, the cover is water resistant and snow repellent. It may be constructed as a polar fleece that wraps around the goggle quickly and securely with magnetic snaps. Rubber pads may be provided to keep the goggles from sliding off a helmet. In an embodiment, a single protective cover may be designed to fit all sized goggles, kids to adults. The protective cover keeps the goggle dry, and vision fog free. Furthermore, the lining may be used to clean the lens of the goggle.

Figure 11:
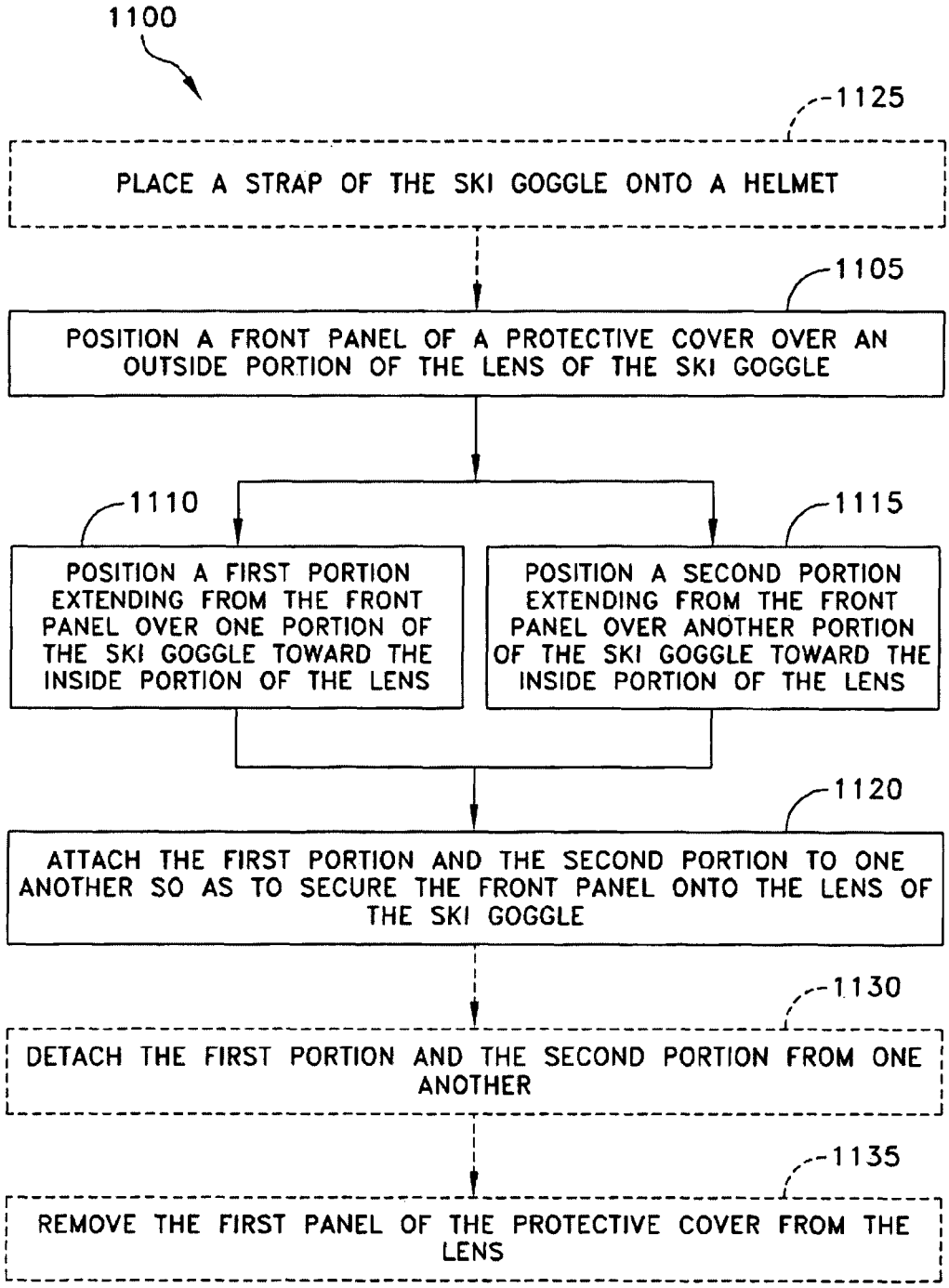
FIGS. 11-13 illustrate various exemplary methods of protecting a lens of a ski goggle.
Figure 12:
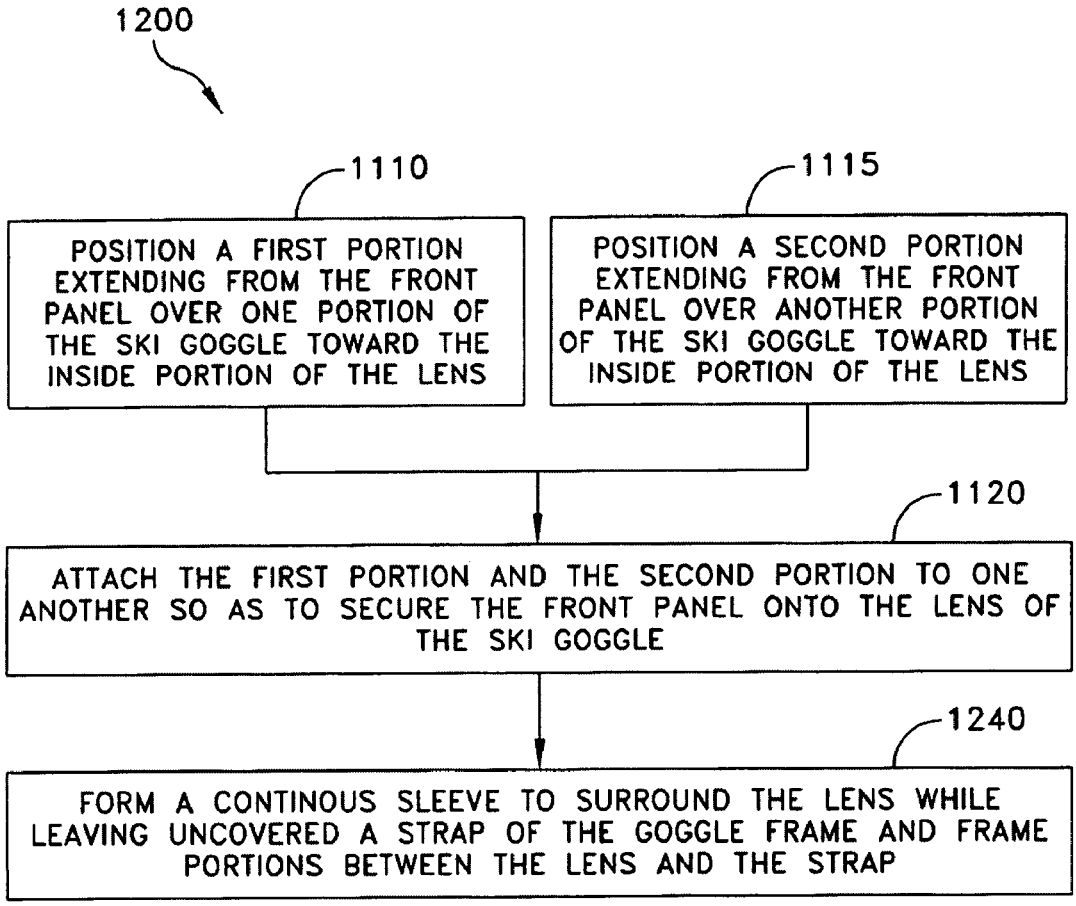

Referring now to FIG. 11, and in an embodiment, there is shown a method 1100 of protecting a lens of a ski goggle. Method 1100 may include positioning 1105 a front panel of a protective cover over an outside portion of the lens of the ski goggle. Method 1100 may further include positioning 1110 a first portion extending from the front panel over one portion of the ski goggle toward the inside portion of the lens. Method 1100 may include positioning 1115 a second portion extending from the front panel over another portion of the ski goggle toward the inside portion of the lens. Method 1100 may also include attaching 1120 the first portion and the second portion to one another so as to secure the front panel onto the lens of the ski goggle.

The steps of positioning 1105 the front panel, positioning 1110 the first portion, positioning 1115 the second portion, and attaching 1120 the first portion and second portion, may occur subsequent to placing 1125 a strap of the ski goggle onto a helmet and while the strap of the ski goggle is attached to the helmet. As the protective cover may be formed without a pouch or pocket, it easily conforms to a goggle positioned on a helmet. When the goggles need to be used, the lenses may be accessed by detaching 1130 the first portion and the second portion from one another. This may be followed by removing 1135 the front panel of the protective cover from the lens. This allows a user to see through the lens.

When using a helmet as discussed above, the steps of detaching 1130 the first portion and the second portion from one another, and removing 1135 the first panel of the protective cover from the lens, may occur subsequent to placing a strap 1125 of the ski goggle onto a helmet and while the strap of the ski goggle is attached to the helmet.

In one embodiment, the steps of positioning 1110 the first portion and positioning 1115 the second portion may occur simultaneously with one another, or may occur in a serial fashion with either step occurring prior to the other one.

The steps of positioning 1110 first portion, positioning 1115 second portion, and attaching 1120 the first portion and second portion include forming 1240 a continuous sleeve to surround the lens while leaving uncovered a strap of the goggle frame and frame portions between the lens and the strap.

Figure 13:
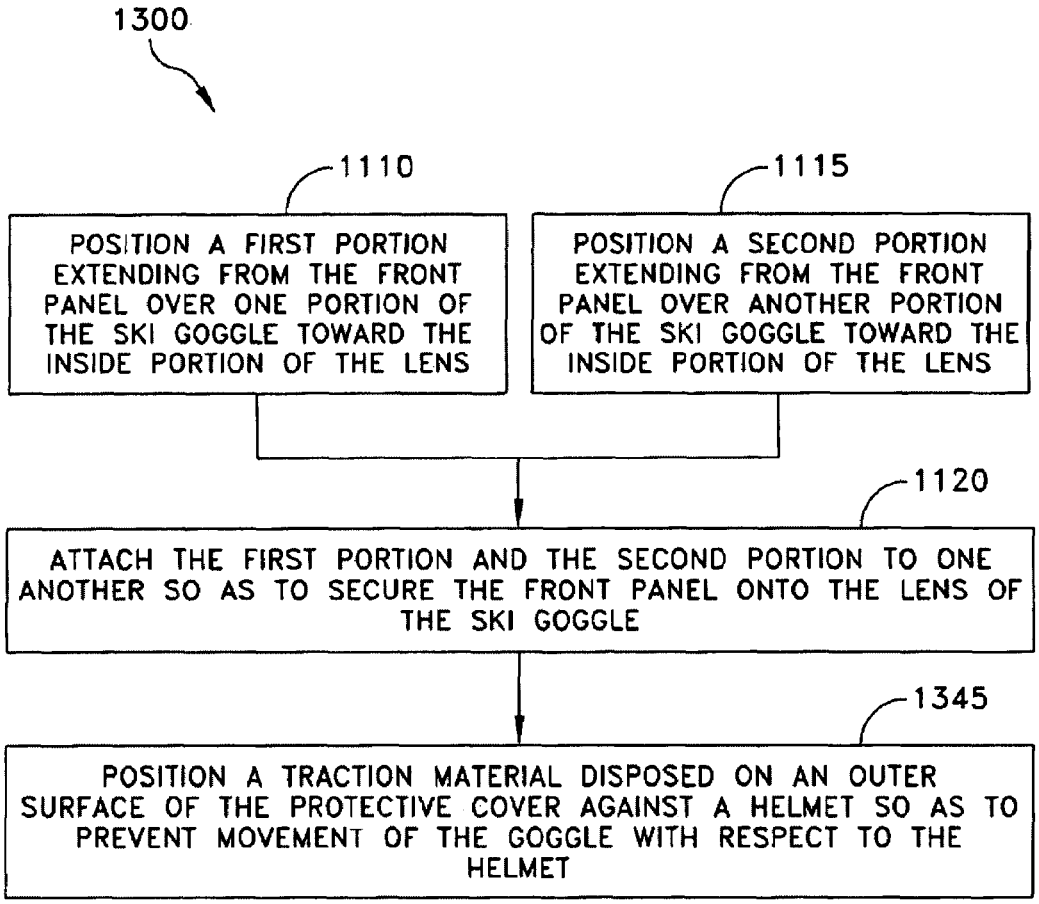

Referring now to FIG. 13, and in an embodiment, one or both of the steps of positioning 1110 the first portion and positioning 1115 the second portion may further include positioning 1345 a traction material disposed on an outer surface of the protective cover against a helmet. This traction material acts to prevent movement of the goggle with respect to the helmet.

What is claimed is:

1. A protective cover for a lens of a ski goggle, the protective cover comprising:

a front panel defining a top boundary and a bottom boundary in opposition to one another, the top boundary and the bottom boundary shaped to substantially contour to a front, outside portion of the lens of the ski goggle, the top boundary contouring to a top portion of the goggle, the bottom boundary contouring to a bottom portion of the goggle, the top boundary and the bottom boundary having an asymmetrical configuration with respect to one another, the asymmetrical configuration configured to allow the protective cover to substantially conform to the front, outside portion of the lens of the ski goggle, and the front panel forming a right lateral edge and a left lateral edge in opposition to one another;

a first portion extending from the top boundary of the front panel to a first end, a first connector mechanism adjacent the first end, and the first portion forming a right lateral edge and a left lateral edge in opposition to one another;

a second portion extending from the bottom boundary of the front panel to a second end, a second connector mechanism adjacent the second end, and the second portion forming a right lateral edge and a left lateral edge in opposition to one another;

wherein the first connector mechanism and the second connector mechanism are configured to selectively attach the first portion and the second portion to one another so as to secure the front panel onto the lens of the ski goggle;

wherein the right lateral edge of the front panel, the right lateral edge of the first portion, and the right lateral edge of the second portion are configured to selectively connect with one another to form the opening extends at least substantially an entire distance of the right lateral edge of the front panel, and the distance of the opening sized to allow a strap of the ski goggle to extend away from the right lateral edge of the front panel when the first connector mechanism and the second connector mechanism are attached together so as to allow attachment of the front panel with respect to the lens while the strap of the ski goggle is attached to a helmet, and the right lateral edge of the front panel, the right lateral edge of the first portion, and the right lateral edge of the second portion are configured to selectively detach from one another to to allow detachment of the front panel with respect to the lens while the strap of the ski goggle is attached to a helmet; and wherein the left lateral edge of the front panel, the left lateral edge of the first portion, and the left lateral edge of the second portion are configured to selectively connect with one another to form an opening, and the opening extends at least substantially an entire distance of the left lateral edge of the front panel, and the distance of the opening sized to allow a strap of the ski goggle to extend away from the left lateral edge of the front panel when the first connector mechanism and the second connector mechanism are attached together so as to allow attachment of the front panel with respect to the lens while the strap of the ski goggle is attached to a helmet, and the right lateral edge of the front panel, the right lateral edge of the first portion, and the right lateral edge of the second portion are configured to selectively detach from one another to allow detachment of the front panel with respect to the lens while the strap of the ski goggle is attached to a helmet.

2. A protective cover according to claim 1, wherein the front panel, the first portion, and the second portion are each individual fabric panels sewn together.

3. A protective cover according to claim 2, wherein each of the fabric panels includes at least one selected form the group consisting of polyester fleece, polyester micro-fiber, polyester fleece with nylon shell material, polyester micro-fiber with nylon shell material, and tactical fabrics.

4. A protective cover according to claim 1, further comprising a traction material disposed on at least one of the first portion and the second portion, and wherein the traction material prevents sliding of the at least one of the first portion and the second portion with respect to a helmet.

5. A protective cover according to claim 4, wherein the traction material is a strip of neoprene rubber.

6. A protective cover according to claim 1, wherein the top boundary and the bottom boundary are asymmetrical.

7. A protective cover according to claim 1, wherein the right lateral edge of the front panel and the left lateral edge of the front panel are mirror images of one another.

8. A protective cover according to claim 1, wherein the right lateral edge of the first portion and the right lateral edge of the second portion each extend continuously from the right lateral edge of the front panel, respectively, and wherein the left lateral edge of the first portion and the left lateral edge of the second portion each extend continuously from the left lateral edge of the front panel, respectively.

9. A protective cover according to claim 1, wherein the first connector mechanism of first lateral portion includes a first set of magnets, and wherein the second connector mechanism of second lateral portion includes a second set of magnets.

10. A protective cover according to claim 9, wherein the first set of magnets is disposed in a horizontal margin adjacent to the first end, and wherein the second set of magnets is disposed in a horizontal margin adjacent to the second end.

11. A protective cover according to claim 1, wherein the first connector mechanism of first lateral portion includes a first set of hook-and-loop fasteners, and wherein the second connector mechanism of second lateral portion includes a second set of hook-and-loop fasteners.

12. A protective cover according to claim 11, wherein the first set of hook-and-loop fasteners is disposed in a horizontal margin adjacent to the first end, and wherein the second set of hook-and-loop fasteners is disposed in a horizontal margin adjacent to the second end.

13. A protective cover according to claim 1, wherein the front panel, the first portion, and the second portion are configured to form a continuous sleeve when the first end and the second end are attached to one another.

14. A protective cover according to claim 1, wherein the opening formed by the right lateral edge of the front panel, the right lateral edge of the first portion, and the right lateral edge of the second portion is sized to engage a first frame portion of the goggles between the lens and the strap, and wherein the opening formed by the left lateral edge of the front panel, the left lateral edge of the first portion, and the left lateral edge of the second portion is sized to engage a second frame portion of the goggles between the lens and the strap.

15. A protective cover for a lens of a goggle, the protective cover comprising:

a front panel shaped to substantially contour to a front, outside portion of the lens of the goggle, the front panel defining a top boundary and a bottom boundary in opposition to one another, the top boundary contouring to a top portion of the goggle, the bottom boundary contouring to a bottom portion of the goggle, the top boundary and the bottom boundary having an asymmetrical configuration with respect to one another, the asymmetrical configuration configured to allow the protective cover to substantially conform to the front, outside portion of the lens of the ski goggle;

a first portion extending from the front panel to a first end, and a first connector mechanism adjacent the first end; and a second portion extending from the front panel to a second end, a second connector mechanism adjacent the second end, the first connector mechanism and the second connector mechanism selectively attaching to one another so as to secure the front panel onto the lens of the goggle, and the front panel, the first portion, and the second portion are configured to selectively connect together to form openings in opposition to one another, the openings extending at least substantially an entire distance of the front panel, so as to allow attachment of the front panel with respect to the lens while the strap of the ski goggle is attached to a helmet, and the front panel, the first portion, and the second portion are configured to selectively detach from one another to allow detachment of the front panel with respect to the lens while the strap of the ski goggle is attached to a helmet, wherein each of the openings are sized to allow a strap of the goggle to extend away from the front panel.

16. A protective cover according to claim 15, wherein the front panel, the first portion, and the second portion are configured to cover a ski goggle.

17. A protective cover according to claim 15, further comprising a traction material disposed on at least one of the first portion and the second portion, and wherein the traction material prevents sliding of the at least one of the first portion and the second portion with respect to a helmet.

18. A protective cover according to claim 17, wherein the traction material is a strip of neoprene rubber.

19. A protective cover according to claim 15, wherein the front panel has a top boundary and a bottom boundary, and wherein the top boundary and the bottom boundary are asymmetrical to one another so as to substantially contour to portions of the goggle.

20. A protective cover according to claim 15, wherein the openings are sized to engage a first frame portion and a second frame of the goggles between the lens and the strap, respectively.

21. A method of protecting a lens of a ski goggle, the method comprising:

positioning a front panel of a protective cover over a front, outside portion of the lens of the ski goggle, the front panel defining a top boundary and a bottom boundary in opposition to one another, the top boundary contouring to a top portion of the goggle, the bottom boundary contouring to a bottom portion of the goggle, the top boundary and the bottom boundary having an asymmetrical configuration with respect to one another, the asymmetrical configuration configured to allow the protective cover to substantially conform to the front, outside portion of the lens of the ski goggle;

positioning a first portion extending from the front panel over one portion of the ski goggle toward an inside portion of the lens;

positioning a second portion extending from the front panel over another portion of the ski goggle toward the inside portion of the lens; and attaching the first portion and the second portion to one another to form an opening extending at least substantially an entire distance of the front panel, and the opening sized to allow the strap of the ski goggle to extend away from the protective cover when the first portion and the second portion are attached to one another so as to secure the front panel onto the lens of the ski goggle while a strap of the ski goggle is attached to a helmet.

22. A method according to claim 21, where in the steps of positioning the front panel, positioning the first portion, positioning the second portion, and attaching the first portion and second portion, occur subsequent to placing the strap of the ski goggle onto a helmet and while the strap of the ski goggle is attached to the helmet.

23. A method according to claim 21, further comprising detaching the first portion and the second portion from one another to allow detachment of the front panel with respect to the lens while the strap of the ski goggle is attached to the helmet, and removing the front panel of the protective cover from the lens, so as to allow a user to see through the lens.

24. A method according to claim 23, wherein the steps of detaching the first portion and the second portion from one another, and removing the first panel of the protective cover from the lens, occur subsequent to placing a strap of the ski goggle onto a helmet and while the strap of the ski goggle is attached to the helmet.

25. A method according to claim 21, wherein the steps of positioning the first portion, positioning the second portion, and attaching the first portion and second portion include forming a continuous sleeve to surround the lens while leaving uncovered a strap of the goggle frame and frame portions between the lens and the strap.

26. A method according to claim 21, further comprising positioning a traction material disposed on an outer surface of the protective cover against a helmet so as to prevent movement of the goggle with respect to the helmet.

* * * * *

UNITED STATES PATENT AND TRADEMARK OFFICE

CERTIFICATE OF CORRECTION

PATENT NO. : 8,151,374 B2
APPLICATION NO. : 11/853639
DATED : April 10, 2012
INVENTOR(S) : Kendra A. Wilcox It is certified that error appears in the above-identified patent and that said Letters Patent is hereby corrected as shown below:

In the claims, column 6, line 9, “another to to allow detachment” should read --another to allow detachment--.

In the claims, column 6, line 34, “selected form the group” should read --selected from the group--.

Signed and Sealed this
Twenty-ninth Day of May, 2012

David J. Kappos

David J. Kappos
*Director of the United States Patent and Trademark Office*